United States Patent [19]

Rozsa

[11] Patent Number: 4,683,945

[45] Date of Patent: Aug. 4, 1987

[54] ABOVE GROUND—BELOW GROUND PUMP APPARATUS

[76] Inventor: Istvan K. Rozsa, 20541 Broadacres, Mt. Clemens, Mich. 48043

[21] Appl. No.: 829,983

[22] Filed: Feb. 18, 1986

[51] Int. Cl.[4] ..... E21B 43/12

[52] U.S. Cl. ..... 166/68.5; 417/378

[58] Field of Search ..... 166/68.5; 417/377, 378, 417/393

[56] References Cited

U.S. PATENT DOCUMENTS

| | | | |
|---|---|---|---|
| 1,543,201 | 6/1925 | Bell . | |
| 1,880,321 | 10/1932 | Jackson . | |
| 2,174,114 | 9/1939 | Will | 417/378 |
| 2,185,727 | 1/1940 | Emmons | 417/378 |
| 2,453,929 | 11/1948 | O'Harah | 417/378 |
| 2,562,584 | 7/1951 | Soberg | 417/378 |
| 2,702,005 | 2/1955 | Kruse | 417/378 |
| 2,982,355 | 5/1961 | Rodgers | 166/68.5 |
| 3,212,406 | 10/1965 | McDuffie | 166/68.5 |
| 3,468,258 | 9/1969 | Arutunoff | 103/87 |
| 3,497,001 | 2/1970 | Brown | 166/120 |
| 3,957,400 | 5/1976 | Roeder | 417/393 |
| 4,084,923 | 4/1978 | Roeder | 417/393 |
| 4,158,389 | 6/1978 | Chammas et al. | 166/297 |
| 4,365,668 | 12/1982 | Bright | 166/214 |

*Primary Examiner*—Stephen J. Novosad
*Assistant Examiner*—William P. Neuder
*Attorney, Agent, or Firm*—Basile, Weintraub & Hanlon

[57] ABSTRACT

An above ground—below ground pump apparatus for use in pumping underground fluids to the ground surface. The pump apparatus includes an above ground pump for alternately propelling fluid into a well casing surrounding the pump apparatus and discharging underground fluid therefrom and a second pump is mounted underground within the well casing at a pre-determined location. The second pump includes alternately movable pistons which draw in fluid from the well casing and discharge the fluid through conduits to the ground surface. An anchoring device is attached to the exterior of the first and second conduits for anchoring the second pump at a pre-determined position within the well casing.

11 Claims, 11 Drawing Figures

ABOVE GROUND—BELOW GROUND PUMP APPARATUS

BACKGROUND OF THE INVENTION

1. Field of the Invention

The present invention relates, in general, to pump apparatus and, more specifically, to above ground and below ground pump apparatus for pumping underground fluids above ground level.

2. Description of the Prior Art

Many different types of pumps have been developed for use in well operations in which the pump is positioned within a well casing to pump underground fluids, such as oil, water, brine, etc., above ground level. Such pumps must be anchored at a desired position within a well casing and, yet, must be able to be easily removed for repair, replacement of parts, etc. Furthermore, such pumps must have a high efficiency and be reliable over long term use.

It has long been felt that previously devised above and below ground pump apparatus could be improved with regard to their efficiency in pumping rates, their long term reliability, as well as the ease in which such pumps are anchored in and removed from the well casing.

Thus, it would be desirable to provide a pump apparatus for above and below ground pumping operations which provide both a high pumping efficiency and long term reliability. It would also be desirable to provide such a pump apparatus which can be easily mounted within a well casing at a pre-determined position and yet be easily removed as when necessary for repair, replacement, etc.

SUMMARY OF THE INVENTION

The present invention is an above ground—below ground pump apparatus for use in well operations for pumping underground fluids to ground level. The pump apparatus includes a first or above ground pump means which alternately pumps fluid under pressure into the well casing and at the same time forces underground fluid out of the well. The output from the first pumping means is connected to a suitable pipeline or reservoir.

Preferably, the first pump means includes first and second fluid-operated cylinders, each having outwardly extensible rods. The outer ends of the rods are formed in a rack or gear portion which is alternately driven by a pair of oppositely oriented sector gears. The sector gears are in turn driven by a continuously running motor such that the gears alternately engage their associated cylinder rod thereby reciprocating each rod in an alternating, bi-directional manner.

The pump apparatus of the present invention also includes an underground or second pump means which is connected to the first pump means by first and second fluid flow conduits. First, second, third and fourth cylinders are formed at the lower end of the first and the second conduits, with the second and fourth cylinders being interconnected in fluid flow communication by an interconnecting third conduit.

First and second pistons, each connected by a interconnecting rod, are mounted in each of the first and second cylinders. A first divider means is interposed between the first and second cylinders and cooperates with the first and second pistons to form first and second fluid chambers. Similarly, third and fourth pistons are co-axially arranged in the third and fourth cylinders, respectively, and interconnected by a connecting rod and separated by a second divider means to form third and fourth fluid chambers. An inlet and an outlet is provided for each of the first, second, third and fourth chambers adjacent the respective first and second divider means. The inlets are provided with check valve means to provide proper fluid flow into and out of the respective fluid chamber.

A first outlet manifold typically in the form of a hollow conduit is connected between the outlet of the second and third fluid chambers at one end and to the first conduit at an opposite end thereby providing a fluid discharge path within the second and third chambers through the first conduit. A similar second outlet manifold is connected between the outlet of the first and fourth fluid chambers and the second conduit.

An unique anchoring means is also provided for anchoring the underground or second pump means of the pump apparatus of the present invention at a pre-determined position with the well casing. The anchoring means includes a pair of spaced plate members which are disposed on opposite sides of a resilient rubber member. A sleeve is mounted concentrically about the first and second conduits by means of cables extending upward to ground level to enable the desired positioning of the anchoring means within the well casing. Three arms are attached to and extend outward from the sides of the sleeve and have a hollow bore extending partially therethrough. The bores are in communication with the fluids on both sides of the resilient member to equalize pressures therebetween when it is desired to remove the anchor means and the second pump means from the well casing.

A plurality of pivotal linkages are attached to the bottom plate member. Each linkage carries at its outward end a wedge member having a toothed or separated, inclined end portion. The end portion of each wedge member engages the side walls of the well casing to hold the anchoring means and the attached conduits and below ground pump means at the selected position within the well casing when the sleeve is urged downward. Upward movement of the sleeve via the cables causes an upward movement of the arms and attached rods thereby collapsing the linkage and disengaging the wedge members from the side walls of the casing to allow removal of the conduits and the entire pump apparatus from the well casing.

The pump apparatus of the present invention provides a pump having an extremely high pumping efficiency in that three volumes of underground fluid are discharged from the pump for each volume of fluid which is input into the well casing via the above ground pump means. Furthermore, the pump apparatus of the present invention is of simple construction thereby providing long term reliability.

The unique anchoring means of the present invention also enables the below ground portion of the pump to be easily positioned at any desired location within the well casing and, at the same time, be easily removed for repair or replacement.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
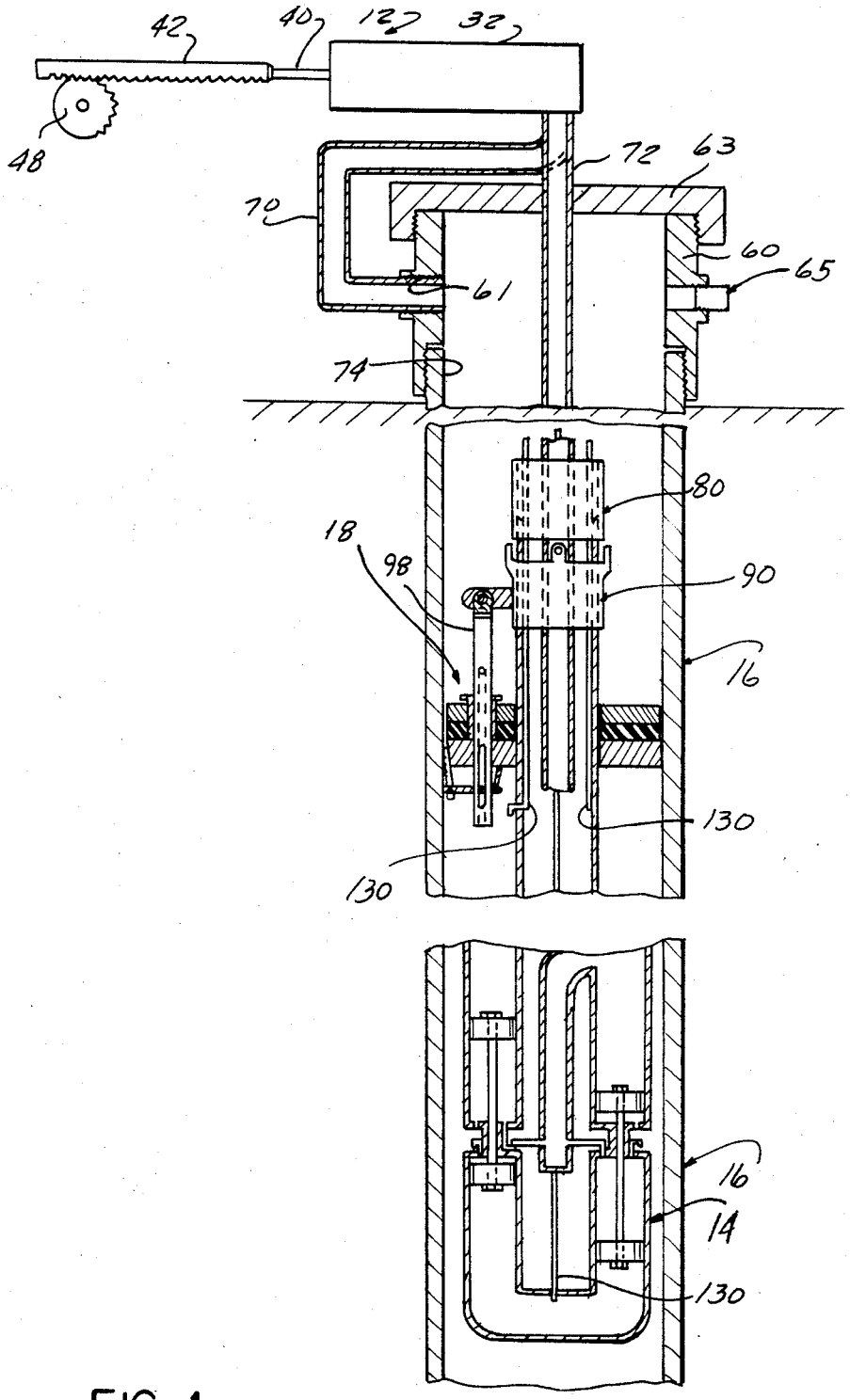
FIG. 1 is a partially sectioned, elevational view of the pump apparatus of the present invention.

Throughout the following description and drawing, an identical reference number is used to refer to the same component shown in multiple figures of the drawing.

The present invention is a pump apparatus suitable for pumping an underground fluid, such as oil, water, brine, etc., from below ground level to above ground level. The pump apparatus, as generally shown in FIG. 1, includes a first or above ground pumping means 12 and a second or underground positioned pumping portion 14 which is held in a pre-determined position or depth within a well casing 16 by an anchoring means 18.

Figure 2:
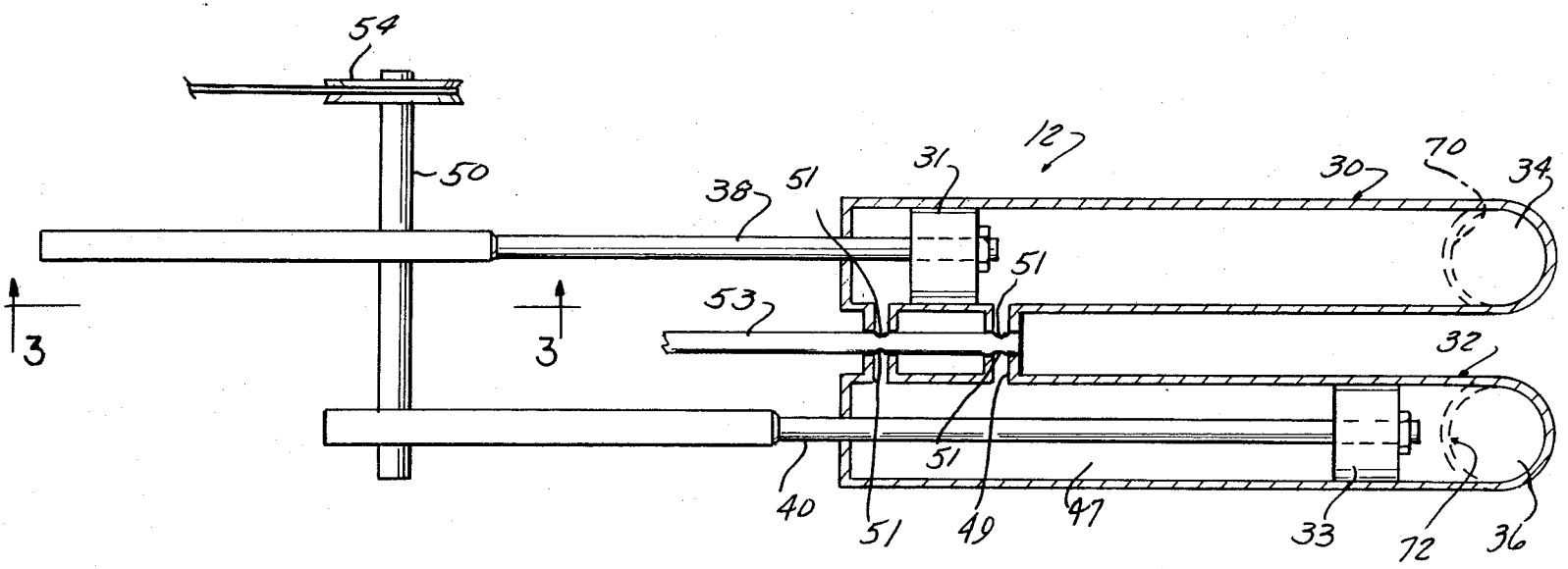
FIG. 2 is a cross-sectional view generally taken along line 2—2 in FIG. 1.
Figure 3:
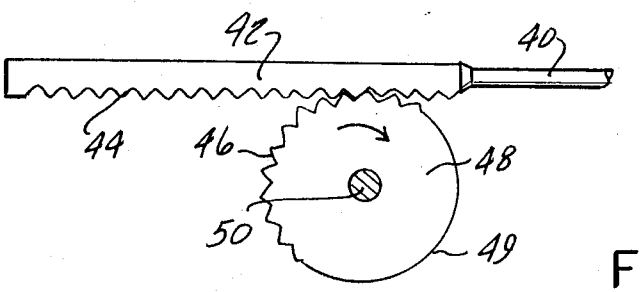
FIG. 3 is a side elevational view generally taken along line 3—3 in FIG. 2.

As shown in greater detail in FIGS. 2 and 3, the first or above ground pumping means 12 provides alternate pumping of a fluid into and out of the well casing 16, through the conduits 72 and 73.

The above ground pumping means 12, as shown in FIGS. 1, 2 and 3, preferably includes a pair of fluid operated cylinders 30 and 32. Each of the first and second fluid-operated cylinders 30 and 32 includes a hollow cylindrical member having an inlet shown generally by reference numbers 34 and 36, respectively, which is connected in fluid flow communication with the conduits as described hereafter. Each cylinder 30 and 32 also contains an extensible and retractable rod 38 and 40, respectively, which is connected to and driven by pistons 31 and 33 slidably mounted within the interior of each cylinder 30 and 32, respectively. The rods 38 and 40 extend outward from one end of each cylinder 30 and 32, respectively.

As shown in greater detail in FIG. 3, the outer end of each cylinder rod, such as rod 40, is formed in a linear gear or rack 42 having a plurality of gear teeth 44 formed on one side. The gear teeth 44 are engageable with similarly formed gear teeth 46 on a rotatable sector gear 48. As shown in Figure 3, the gear teeth 46 on the sector gear 48, one of which is provided for each of the rods 38 and 40, are formed on only a 180° arc of each sector gear 48. The sector gears 48 are fixedly mounted on a shaft 50, as shown in FIG. 2, which has any suitable drive means operably coupled thereto for rotating the shaft 50. By way of example only, a pulley 54 is mounted on the shaft 50 and connected by a belt and a second pulley, not shown, to the output shaft of a motor or engine. Alternately, a direct drive, a gear or a chain drive may also be used to rotate the shaft 50.

Further, it should be noted that the orientation of the two sector gears 48 are offset by 180° such that when the gear teeth 46 on one sector gear 48 are engaging the associated gear teeth 44 on its corresponding rod, the opposite sector gear 48 is disengaged from its rod as the smooth or non-gear tooth section.49 is passing over the gear teeth 44 of the opposite rack 42. This provides alternating, reciprocal movement of the rods 38 and 40 within each cylinder 30 and 32 thereby alternately forcing fluid through one of the cylinders, such as cylinder 30, into the inlet 34 and at the same time forcing fluid up from the underground portion 14 of the pump apparatus 10 through the inlet 36 in the opposite cylinder 32 thereby forcing its piston 33 in a forward direction discharging the fluid within the interior fluid chamber 47 through the discharge ports or apertures 51 into an outlet manifold 53 to a pipeline or storage reservoir, not shown. Upon the opposite stroke, fluid is expelled from the opposite cylinder 32 through its outlet ports 49 and 51 into the outlet manifold 53.

As also shown in FIG. 1, the first pump means 12 is positioned above ground level with the inlets 34 and 36 of the cylinders 30 and 32 positioned above the upper end 74 of a well casing 16. The well casing 16 may be formed in any conventional manner, such as of concrete or metallic hollow tubing, etc., and to any length as required.

A collar 60 having bores 61 and 62 formed therein is threadingly connected to the upper end of the well casing 16. A cap 63 is threadingly and sealingly secured to the upper end of the collar 60 to close off the upper end of the well casing 16. The bore 62 is closed by a threaded plug 65. A first conduit 70 extends between the inlet 34 of the first cylinder 30 to the first bore 61 in the collar 60 providing a fluid flow path therebetween to the interior of the well casing 16. A second conduit 72 extends from the inlet 36 of the second cylinder 32 through the cap 63 in a sealing manner downward into the well casing 16 to the depth or location of the below ground pumping portion 14 of the present invention. This arrangement provides a fluid flow path between the above ground pumping means 12 and the below ground pumping means 14 as will be described in greater detail hereafter.

Figure 4:
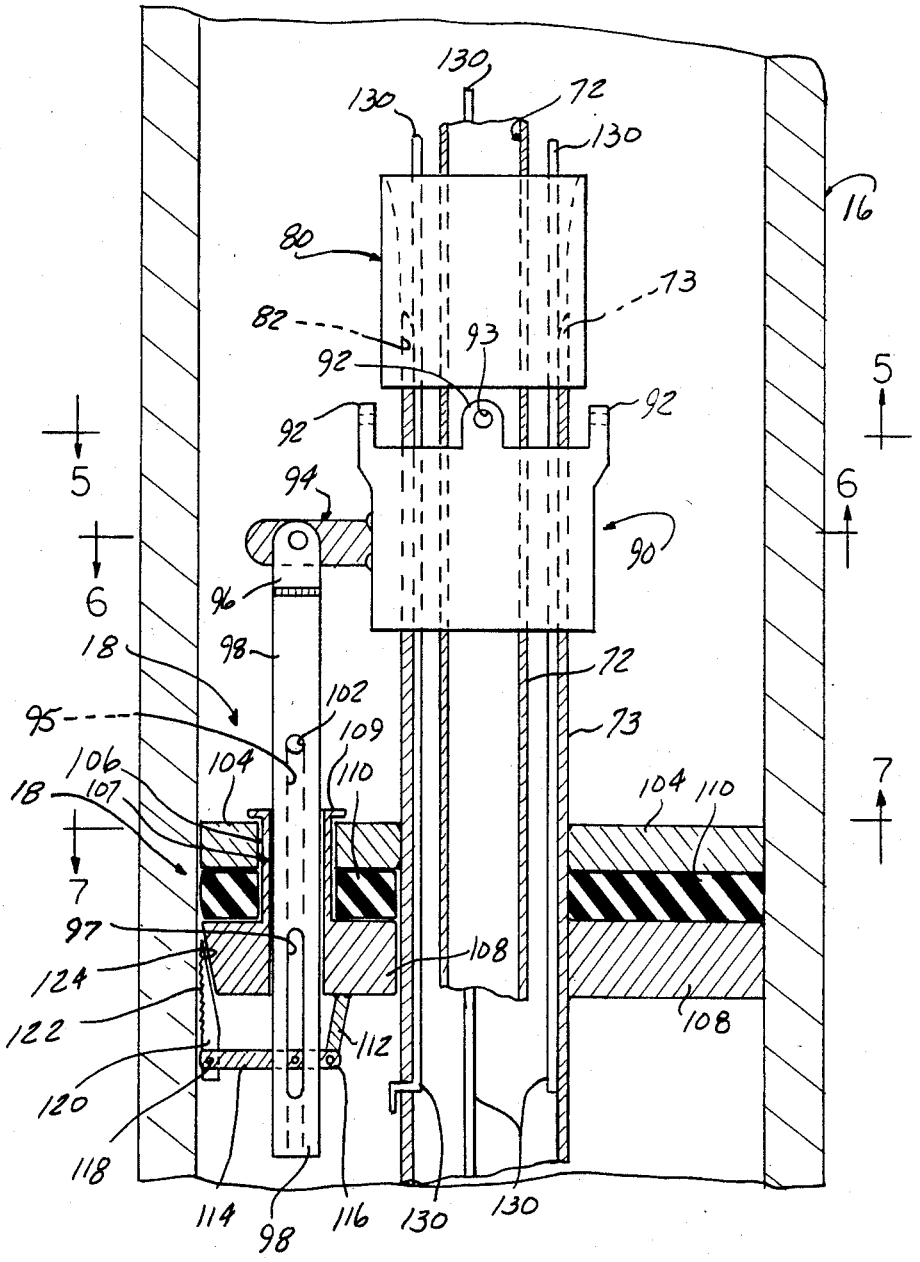
FIG. 4 is a partially sectioned, side elevational view of the anchoring means of the pump apparatus of the present invention.
Figure 5:
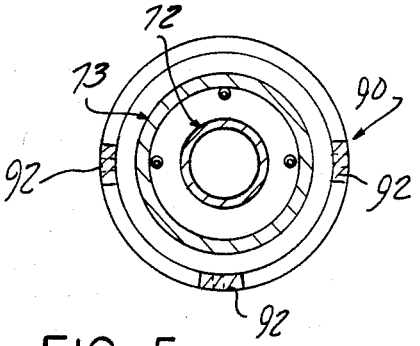
FIG. 5 is a cross sectional view generally taken along line 5—5 in FIG. 4.
Figure 6:
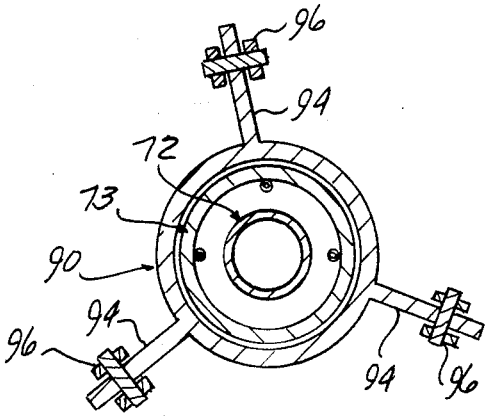
FIG. 6 is a cross sectional view generally taken along line 6—6 in FIG. 4.
Figure 7:
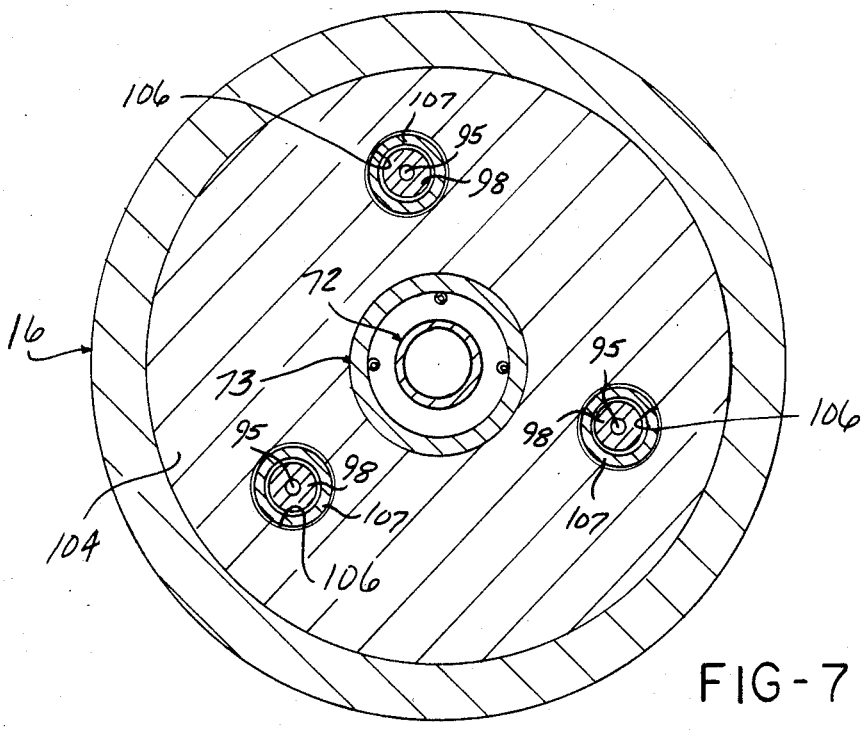
FIG. 7 is a cross sectional view generally taken along line 7—7 in FIG. 4.

As shown in FIG. 4, a collar 80 is concentrically disposed about the second conduit 72. The collar 80 includes a plurality of internal threads 82 which threadingly receive the upper end of an outer conduit 73, also concentrically disposed about the second or innermost conduit 72. The outer conduit 73 extends downward along with the lower extent of the second conduit 72 to the below ground pump means 14, as will be described in greater detail thereafter.

Referring now to FIGS. 4–7, there is illustrated the anchoring means 18 used to position and securely hold the second or below ground pump means 14 at a predetermined position within the well casing 16. The anchoring means 18 also includes a hollow sleeve 90 having a plurality, preferably three, of upwardly extending fingers 92 mounted at an upper end. Each finger 92 includes an aperture 93 which receives one end of a three-part cable, not shown, which is used to raise and lower the sleeve 90 and part of the attached anchoring means 18. As can be best seen in FIG. 5, the three fingers 92 are unequally positioned about the circumference of the sleeve 90; and are offset to one side of the sleeve 90 to provide a disjoining force when the cable is raised to urge the sleeve 90 upward in order to remove the below ground pump means 14 from the well casing 16.

Equally spaced about the periphery of the exterior of the sleeve 90 are a plurality, such as three, of outwardly extending arms 94. The arms 94 extend horizontally outward from the sides of the sleeves 90 and include an aperture which receives a pivot connection for receiving a U-shaped flange member 96 attached to the upper end of a partially hollow rod 98 shown in FIGS. 4 and 6. The rod 98 has an interior bore 95 which extends upward from the opposite end of the rod 98 and terminates in an outlet 102 at an intermediate portion of the length of the rod 98. A slot 97 is formed in an intermediate portion of the rod 98 communicating to the bore 95 to the exterior fluid.

A first or upper plate 104 preferably formed of a metallic material, such as steel, is fixedly attached to the surface of the conduit 73. The first plate 104 has three spaced apertures 106 through which the rods 98 extend. An annular, flange 107 is attached to and extends upward from a second or lower plate 108 and terminates in an outwardly radially-extending portion 109. The second plate 108 is spaced below the first plate 104 and separated therefrom by a pad 110 formed of a resilient material, such as rubber.

A linkage formed of first and second link members 112 and 114 is attached to the bottom of the second plate 108 at one end pivotally to each other at an intermediate connection 116 and pivotally at an outer end 118 to a wedge shaped member 120. The wedge shaped member 120 has a plurality of inclined teeth 122 formed on an outer inclined position thereof. The inclined portion of the wedged shape member 120 slidingly fits within a correspondingly shaped inclined portion formed on the outer peripheral surface of the second plate 108.

In positioning the underground pump apparatus 14 within the well casing 16, the pump apparatus 14 is suspended by the conduit 72 within the well casing 16 at a pre-determined position. The cable, not shown, attached to the sleeve 90, is then pulled into tension which, through the linkage members 116 and 118, forces the wedge member 122 between the inclined portion 124 of the second plate 108 and the well casing 16 to bring the anchoring means 18 into secure engagement with the interior surface of the well casing 16.

The wedging of the wedge member 120 into the side walls of the well casing 16 and the bottom plate 108 also drives the bottom plate 108 upward toward the upper or first plate 104. This compresses the resilient member 110 disposed between the first and second plates 104 and 108 expanding it outward and forming a fluid tight seal between the outer periphery of the outer most conduit 73 and the side walls of the well casing 16 for reasons which will become more apparent in the following description.

An upward force exerted on the conduit 72 will cause the outlet 102 to be moved above the upper portion 109 of the flange 107 and cause the hydrostatic pressures above and below the pad 110 to be balanced. This will create an upward force to be exerted on conduit 73 which will cause a release of the wedge members 122 from the well casing 16. This releases the anchor means 18 from the well casing 16 and enables the underground pump apparatus 14 to be raised or repositioned with the well casing 16 as desired.

Figure 8:
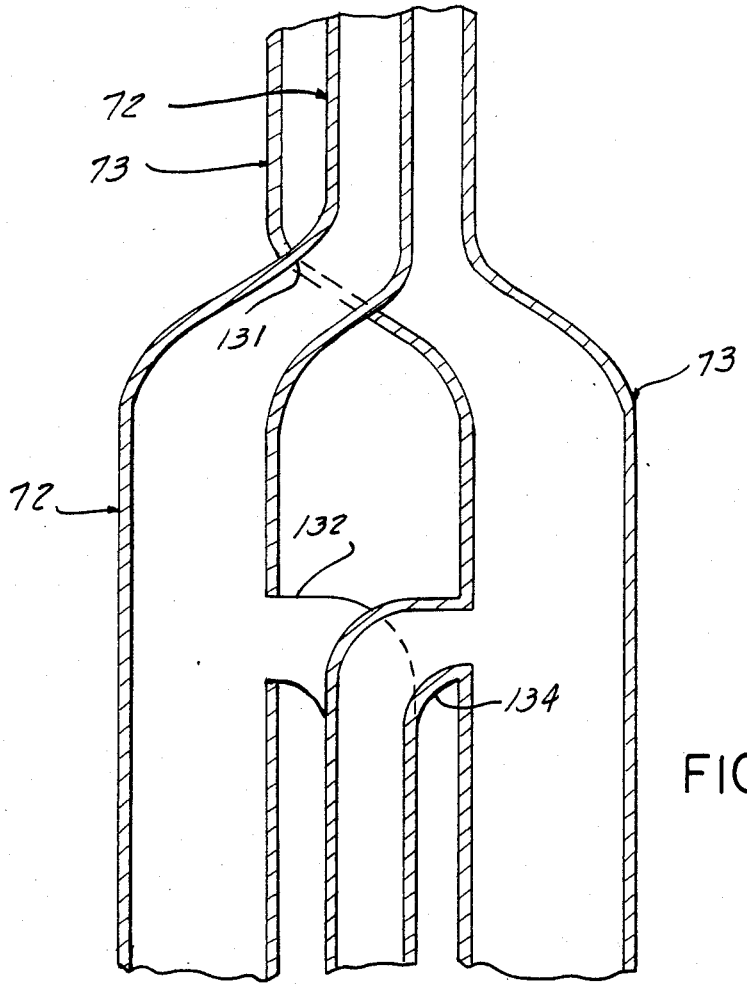
FIG. 8 is an enlarged, partially sectioned view of the interconnection of the inner and outer conduits of the pump apparatus of the present invention.

As shown in FIG. 8, between the anchor means 18 and the underground pump means 14, the concentrically disposed conduits 72 and 73, respectively, separate into two side-by-side positioned conduits. This is achieved by passing the first or inner conduit 72 through an aperture 131 formed in the side wall of the outer conduit 73. The conduits 72 and 73 are then angled outward before assuming a generally vertical orientation as shown in FIG. 8 for the remainder of their length.

The lower portions of the conduits 72 and 73 are provided with additional apertures for receiving the outlet or discharge end of a fluid flow conduit, such as conduit 132 for the inner conduit 72 and conduit 134 for the outer conduit 73, the purposes of which will be described in greater detail below.

Figure 9:
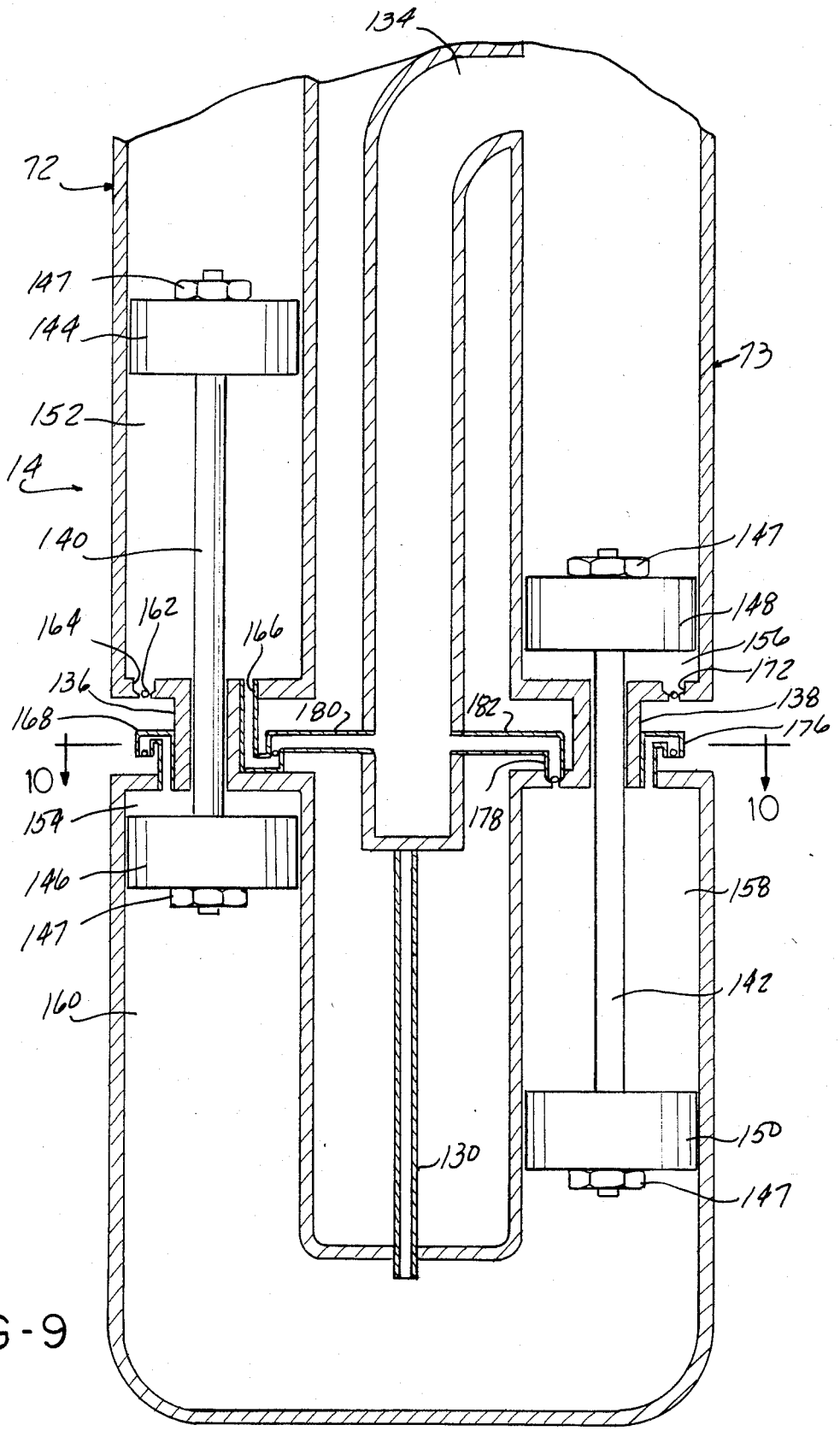
FIG. 9 is an enlarged, partially sectioned view of the underground pump means of the present invention shown generally in FIG. 1.

The bottom ends of the inner and outer conduits 72 and 73 are closed by first and second divider members 136 and 138, respectively, as shown in FIG. 9. The first and second divider members 136 and 138 have a reduced diameter section from that of the inner and outer conduits 72 and 73 and are formed with a through bore through which extends a connecting rod, such as connecting rods 140 and 142, respectively. First and second pistons 144 and 146 are connected via suitable bolts or fasteners to opposite ends of the connecting rod 140. Similarly, third and fourth pistons 148 and 150 are connected via bolts 147 to opposite ends of the opposed connecting rod 142.

The pistons 144, 146, 148 and 150 along with the interior surfaces of the first and second dividers 136 and 138 form first, second, third and fourth fluid chambers 152, 154, 156 and 158, respectively, within the ends of the conduits 72 and 73. It should be noted that the lower ends of the inner and outer conduits 72 and 73 are connected by a third conduit 160 which disposes the outer faces of the pistons 146 and 150 in fluid flow communication.

The first and second divider members 136 and 138 as well as the bottom and top end surfaces of the first, second, third and fourth fluid chambers 152, 154, 156 and 158, respectively, are formed with inlet and outlet apertures for the inflow and discharge of fluid into and out of each of the fluid chambers. Each inlet and outlet in general is formed with an opening aperture in which a check valve means is mounted to allow fluid flow only in one direction through the aperture. Preferably, each check valve means is formed with a ball 162 which sealingly closes the aperture in the inlet or outlet by gravity. A screen or mesh, not shown, is mounted above the ball 162 to hold the ball 162 in position, to allow its movement for fluid flow there past and yet retain the ball 162 in position adjacent the inlet or outlet aperture.

Figure 11:
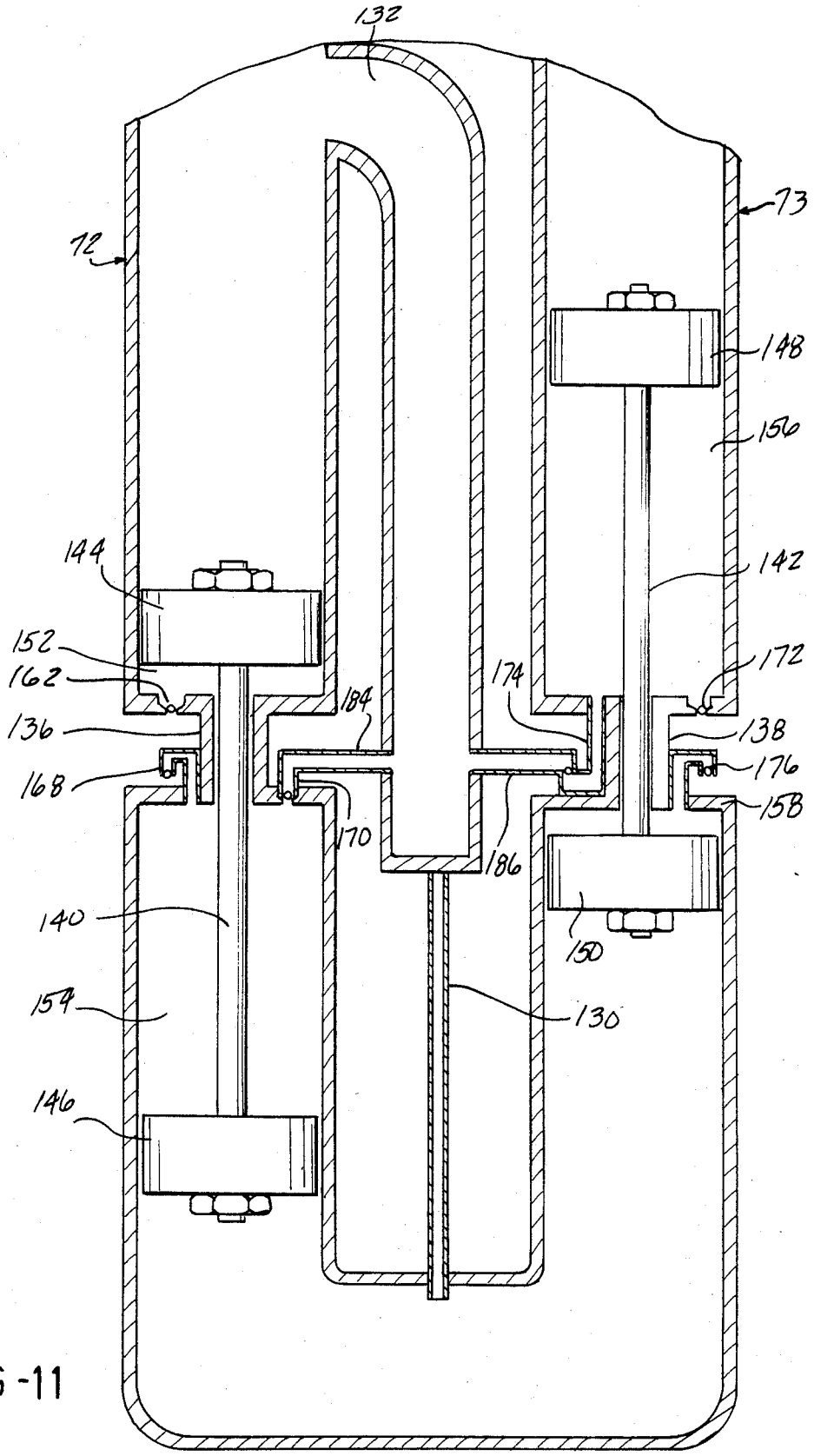
FIG. 11 is a view similar to FIG. 9, but showing the fluid connections to the opposite discharge conduit of the pump apparatus of the present invention.

Specifically, the first fluid chamber 152 is provided with a first inlet 164 and an outlet 166. The second fluid chamber 154 is provided with an inlet 168 and an outlet 170 as shown in FIG. 11. Similarly, the third fluid chamber 156 has an inlet 172 as shown in FIG. 9 and an outlet 174 as shown in FIG. 11. Finally, the fourth fluid chamber 158 is provided with an inlet 176 and an outlet 178.

Figure 10:
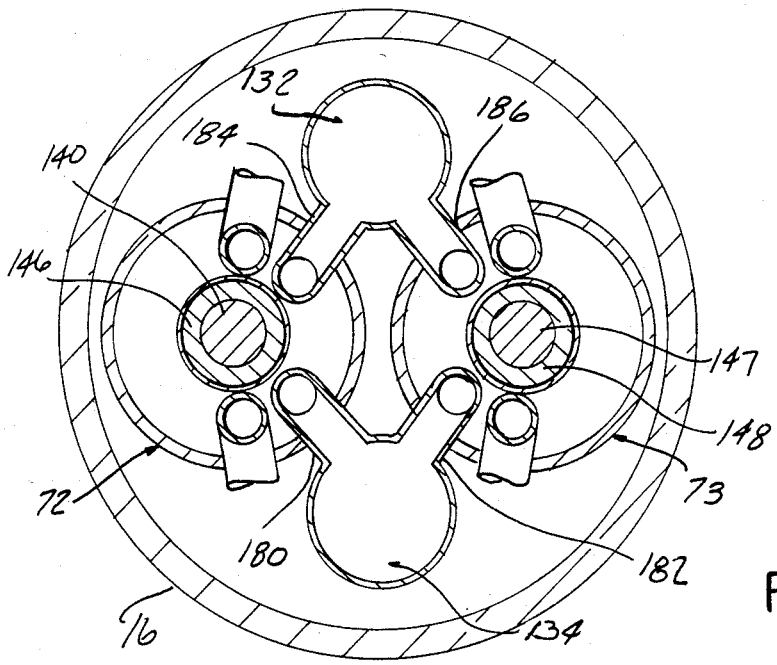
FIG. 10 is a cross sectional view generally taken along line 10—10 in FIG. 9.

As shown in FIGS. 9, 10 and 11 the inlets 164, 168, 172 and 176 are disposed in fluid flow communication at one end with the interior of the well casing 16 to provide an inflow of underground fluid into the corresponding fluid chambers within the underground pump apparatus 14.

As shown in FIG. 9, the outlet 166 from the first fluid chamber 152 and the outlet 178 from the fourth fluid chamber 158 are disposed in fluid flow communication with the first discharge conduit 134 via connecting tubes 180 and 182, respectively, which extend between the outlets 166 and 178 and the first discharge conduit 134. This provides a discharge path for the fluid contained within the fluid chambers 152 and 158 through the discharge conduit 134 into the outer conduit 73.

As shown in FIG. 11, a similar connection is provided between the outlets 170 and 174 of the second and third fluid chambers 154 and 156, respectively, to the first discharge conduit 132 via interconnecting tubes or conduits 184 and 186, respectively. This provides a discharge path for fluid contained within the fluid chambers 154 and 156 through the first discharge conduit 132 into the inner conduit 72.

As shown in FIG. 10, the conduits 72 and 73 are spaced on opposite sides of the discharge conduits 132 and 134 with the connections extending between the discharge conduits 132 and 134 through the first and second divider members 136 and 138 to the respective fluid chambers 152, 154, 156 and 158.

The operation of the below or underground pump means 14 will now be described with reference to FIGS. 9, 10 and 11. In FIG. 9, the below ground pump means 14 is illustrated in the start position with the piston assembly formed by the pistons 144 and 146 and connecting rod 140 in an up position forming a large volume in the first chamber 152 and a small volume in the second fluid chamber 154. The second piston assembly formed by pistons 148 and 150 and the interconnecting rod 152 is in the down or lowered position forming a small volume in the third fluid chamber 156 and a large volume in the fourth fluid chamber 158.

At this time, the first fluid chamber 152 and the fourth fluid chamber 158 will be completely filled with fluid previously drawn in through the inlets 164 and 176. Reciprocation of the drive cylinders 30 and 32, as described above, will result in downward fluid flow with the first conduit 72 and upward fluid within the second conduit 73. This will result in a downward force being exerted by the fluid on the piston 144 forcing it downward to the position shown in FIG. 11. During such movement, the piston 144 forces the fluid within the first fluid chamber 152 outward through the outlet 166 into the second discharge conduit 134. Simultaneously, the second piston 146 exerts a force on the fluid contained within the third conduit 160 which causes an upward movement of the fourth piston 150 and the piston assembly comprised of the third and fourth pistons 148 and 150. This causes a discharge of the fluid within the fourth fluid chamber 158 through the conduit 182 into the second discharge conduit 134 and thence into the outer conduit 73.

During the reciprocal movement of the pistons 144, 146 and 148 and 150 within their respective fluid cylinders, a vacuum will be created by the movement of pistons 146 and 148 drawing fluid from the well casing 16 through the inlets 168 and 172, respectively, into the second and third fluid chambers 154 and 156 thereby filling each fluid chamber 154 and 156 with fluid from the well.

If a volume of fluid is injected from one of the cylinders 30 or 32, such as cylinder 30, into the inner conduit 72 sufficient to move the piston 144 to its full stroke, the fluid drawn into the chamber 152 on the last upstroke of the piston 144 will be discharged through the discharge conduit 134 along with fluid from the corresponding chamber 158 on the upstroke of the piston 150 due to the transmission of fluid force between the pistons 146 and 150 within the third conduit 160 into the discharge conduit 134. Furthermore, the upward movement of the piston 148 will also force the same volume of fluid contained above the upper surface of the piston 148 and the lower end of the conduit 73 upward through the conduit 73. Thus, for each volume of fluid injected into the well casing 16, three volumes of fluid are discharged therefrom, thereby providing a 3:1 output.

As shown in FIGS. 1, 4, 9 and 11, a plurality of, preferably three, conduits 130 extend through various portions of the inner and outer conduits 72 and 73. The conduits 130 control and insure proper fluid balance between the various portions of the underground pump apparatus 14.

In summary, there has been disclosed an unique above and below ground pump apparatus which provides increased efficiency and reliability over previously devised above and below ground pump apparatus. An unique anchoring means is also provided for anchoring the below ground portion of the pump apparatus of the present invention at a pre-determined location within the well casing. The anchoring means, while securely maintaining the below ground pump portion in a desired position, is also easily removable for repair or replacement of or the below ground pump apparatus.

What is claimed is:

1. A pump apparatus for above ground and below ground pumping installations within a well casing comprising:

first pump means mounted above ground for alternately pumping fluid into and out of the well casing;

discharge means connected to the first pump means for discharging fluid from the first pump means;

second pump means mountable within the well casing for pumping underground fluid from the well casing to the ground surface;

first and second conduit means disposed in fluid flow communication between the first and second pump means;

first, second, third and fourth fluid cylinders;

a third conduit having opposed ends;

the first and second fluid cylinders being formed in the end of the first conduit means and one end of the third conduit and the third and fourth fluid cylinders being formed in the end of the second conduit means and the opposite end of the third conduit;

first and second divider means separating the first and second cylinders, and the third and fourth cylinders, respectively;

first and second pistons interconnected by a connecting rod and reciprocally movable in the first and second fluid cylinders, the first and second pistons in conjunction with the first and second fluid cylinders and the first divider means forming first and second fluid chambers;

third and fourth pistons interconnected by a connecting rod and reciprocally movable in the third and fourth fluid cylinders, the third and fourth pistons in conjunction with the third divider means forming third and fourth fluid chambers;

an inlet and an outlet formed on each fluid cylinder for the ingress and egress of fluid;

check valve means mounted within each inlet and outlet for allowing fluid to flow from the well casing into the inlet only and fluid to flow from the fluid cylinder outward through the outlet only;

means connected to selected ones of the outlets of the fluid cylinders for providing a fluid flow path from the fluid cylinders to the first and second conduit means; and means for anchoring the second pump means at a predetermined position within the well casing.

2. The pump apparatus of claim 1 wherein the first and second divider means each comprise a member having a central bore extending therethrough, the member being positioned between the first and second fluid cylinders and the third and fourth fluid cylinders, respectively; and the inlets and outlets being formed in the first and second divider members.

3. The pump apparatus of claim 1 further including fourth, fifth and sixth conduit means, the fourth conduit means in fluid communication between the first pump means and the well casing;

the fifth conduit means disposing the outlets of the first and fourth fluid chambers in fluid flow communication with the second conduit; and the sixth conduit means disposing the outlets of the second and third fluid chambers in fluid flow communication with the first conduit means for the discharge of underground fluid from the well casing through the fourth conduit means.

4. The pump apparatus of claim 1 wherein the first and second conduit means are concentrically disposed between the first and second pump means.

5. The pump apparatus of claim 1 wherein the first pump means comprises:

first and second upper fluid cylinders mounted above ground level, each including a reciprocal piston mounted at one end of an extensible and retractable cylinder rod; and means for reciprocally moving the cylinder rods in an alternating manner to alternately inject fluid under pressure into one of the upper cylinders while allowing the egress of fluid from the opposed upper cylinder.

6. The pump apparatus of claim 5 wherein the means for reciprocating the cylinder rods comprises:

a rack formed on the exterior end of each cylinder rod; first and second sector gears, each of the first and second sector gears having gear teeth engageable with the rack portion of the first and second cylinder rods, the first and second sector gears being disposed 180° from each other such that the gear teeth on the first and second sector gears alternately engage corresponding rack portions of the first and second cylinder rods; and means for rotatably driving the sector gears.

7. The pump apparatus of claim 6 wherein the driving means comprises:

a motor having an output shaft;

a shaft connecting the first and second sector gears; and means for transmitting rotation of the output shaft to the shaft connecting the first and second sector gears.

8. The pump apparatus of claim 7 wherein the transmitting means comprises:

a pulley mounted on the shaft connecting the first and second gears; and belt means connecting the pulley to the output shaft of the motor.

9. The pump apparatus of claim 1 wherein the anchoring means comprises:

a first plate fixedly connected to the conduit means;

a second metallic plate spaced from the first plate;

a resilient member disposed between the first and second plates; and a pivotal linkage comprising a first link attached to and extending from the second plate, a second horizontally extending link pivotally conected to the outer end of the first link, wedge means mounted on the outer end of the second link and pivotally connected thereto, the wedge means having means for forceably engaging the interior wall surfaces of the well casing to lock the anchoring means at a pre-determined position along the well casing.

10. The pump apparatus in claim 9 wherein the anchoring means further comprises:

a sleeve slidably disposed about the exterior of the first and second conduit means cable means attached to the sleeve for raising and lowering the sleeve along the length of the first and second conduit within the well casing;

an arm fixedly mounted on the sleeve and extending radially outward therefrom; and a hollow conduit attached to the arm slidably disposed through the first and second metallic plates and the resilient member.

11. The pump apparatus of claim 10 further including a plurality of anchoring means circumferentially spaced about the first and second conduit means.

* * * * *